US007242876B2

(12) United States Patent
Zaima

(10) Patent No.: US 7,242,876 B2
(45) Date of Patent: Jul. 10, 2007

(54) IMAGE FORMING APPARATUS WITH DEVELOPER SUPPLY AMOUNT TARGET VALUE CORRECTING FEATURE USING DETECTED DATA RELATING TO APPARATUS AMBIENT ENVIRONMENT AND INFORMATION RELATING TO A SEALED DEVELOPER SUPPLY CONTAINER ENVIRONMENT

(75) Inventor: Nobuhiko Zaima, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 10/411,104

(22) Filed: Apr. 11, 2003

(65) Prior Publication Data

US 2003/0194245 A1 Oct. 16, 2003

(30) Foreign Application Priority Data

Apr. 16, 2002 (JP) ..... 2002-113861

(51) Int. Cl.
*G03G 15/00* (2006.01)
*G03G 15/08* (2006.01)

(52) U.S. Cl. ..... 399/27; 399/44; 399/49

(58) Field of Classification Search ..... 399/44, 399/49, 27, 53

See application file for complete search history.

(56) References Cited

U.S. PATENT DOCUMENTS 5,666,588 A * 9/1997 Uchiyama et al. ..... 399/44
5,722,007 A 2/1998 Ogata et al. ..... 399/49
5,812,903 A * 9/1998 Yamada et al. ..... 399/49
5,983,044 A * 11/1999 Kodama et al. ..... 399/49
2002/0051142 A1 5/2002 Ogata et al. ..... 358/1.8

FOREIGN PATENT DOCUMENTS

JP 04310978 A * 11/1992
JP 2001194837 A * 7/2001

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image forming apparatus including: an image forming device for forming a toner image on an image bearing member by using a developer contained in a developing container; a density sensor for detecting a density of a detection toner image formed by the image forming device; a control device for controlling an amount of the developer to be supplied from a developer supplying container into the developing container in accordance with an output of the density sensor and a target value; a correcting device for correcting the output of the density sensor in accordance with an ambient environment; and a setting device for setting a value obtained by the correcting device as the target value.

4 Claims, 7 Drawing Sheets

IMAGE FORMING APPARATUS WITH DEVELOPER SUPPLY AMOUNT TARGET VALUE CORRECTING FEATURE USING DETECTED DATA RELATING TO APPARATUS AMBIENT ENVIRONMENT AND INFORMATION RELATING TO A SEALED DEVELOPER SUPPLY CONTAINER ENVIRONMENT

BACKGROUND OF THE INVENTION

1. Field of the Invention

The present invention relates to an image forming apparatus employing an electrostatic recording process or an electrophotographic process. More specifically, the present invention relates to an image forming apparatus such as a copying machine, a printer, and a fax machine.

2. Related Background Art

In the image forming apparatuses such as laser beam printers using a two-component developer mainly composed of toner and carrier, toner is consumed each time an image is formed so that the developer density (mixture ratio between toner and carrier) within a developing device varies. For this reason, in order to maintain the developer density constant, a technique for accurately detecting the developer density becomes important.

The detection of the developer density is usually performed by an optical sensor. A patch latent image is formed on an electrically charged photosensitive drum (drum-shaped electrophotographic photosensitive member) at a predetermined latent image contrast. The patch latent image is then developed using a two-component developer contained in a developing device to obtain a patch image. Light is irradiated to the patch image formed on the photosensitive drum by an optical sensor to detect the developer density based on the magnitude of reflected light obtained at this time.

An initial density, which serves as the reference for the magnitude of reflected light, is set when installing the image forming apparatus and when replacing the developer. The initial density is set to such a density (hereinafter referred to as the "reference density") that allows the sensitivity of the optical sensor to be optimized. When installing the image forming apparatus and when replacing the developer, developer is fed from a sealed container into a developing container of the developing device. The developer within the sealed container is moisture-conditioned to the moisture content within the sealed container (hereinafter referred to as the "container moisture content"). While the developer is being fed into the developing container of the developing device, however, it comes into contact with the outside air so that it is moisture-conditioned to a moisture content (hereinafter referred to as the "ambient moisture content") detected by an environmental sensor provided in the image forming apparatus.

In the meantime, the triboelectricity (triboelectrification charge amount) of the developer also changes from a value corresponding to the container moisture content to a value corresponding to the ambient moisture content. Accordingly, it is common that the initial density is so controlled as to become the reference density in all environments, by changing the latent image contrast in accordance with a detected value of the environmental sensor.

In recent years, in order to achieve higher image quality, toner and carrier contained in developer tend to be reduced in particle size. Such developer including toner and carrier with reduced particle sizes have a larger surface area as a whole as compared with developers having the same weight but larger particle sizes. An increased surface area means a longer time required for moisture-conditioning the developer. Accordingly, when installing an image forming apparatus and when replacing developer, the developer is not sufficiently moisture-conditioned before setting the initial density of a patch image, so that the initial density is set before the triboelectricity of the developer becomes a value corresponding to the moisture content detected by the environmental sensor.

A moisture content (the mass of water contained in 1 $m^3$ of air) within a sealed container is dependent on the environment under which a developer is filled into the sealed container. It is generally about 10 g. Since a sealed container is hermetically sealed, the container moisture content varies little even after passage of a long period of time. For instance, consider a case where the moisture content in the sealed container is 10 g and the moisture content detected by the environmental sensor when installing the image forming apparatus and when replacing developer is 1 g. In this case, the latent image contrast is set to a value corresponding to the moisture content of 1 g, whereas the triboelectrification charge amount of the developer is determined to a value corresponding to the moisture content of 10 g, causing a phenomenon in which the density of the patch image largely deviates from the reference density.

As a result, it is impossible to perform the setting of the initial density, or even if it is possible, the initial density largely deviates from the reference density.

As in the latter case, if an initial density deviates largely from a reference density, the density detection by a density sensor is performed within a density range where the sensor sensitivity is poor, so that the control of the developer density becomes unstable. Consequently, the density of a patch image, which is formed when developer is moisture-conditioned and thus the triboelectricity thereof changes, becomes low and due to an output from the density sensor that has detected this, toner is supplied into the developer so as to increase the developer density, with the result that the developer density is raised to an abnormally high level. This results in fogging or toner scattering, or in some extreme cases, even an overflow of developer from the developing device.

SUMMARY OF THE INVENTION

An object of the present invention is to provide an image forming apparatus in which initial setting of a target value to be compared against an output of a density sensor can be performed with accuracy when initially installing the image forming apparatus, when replacing developer, and the like.

Another object of the present invention is to provide an image forming apparatus in which a developer supply control after the initial setting of the target value can be performed in a satisfactory manner.

The above and other objects of the present invention will be apparent from the following detailed description taken in conjunction with the accompanying drawings.

DESCRIPTION OF THE PREFERRED EMBODIMENTS

Figure 1:
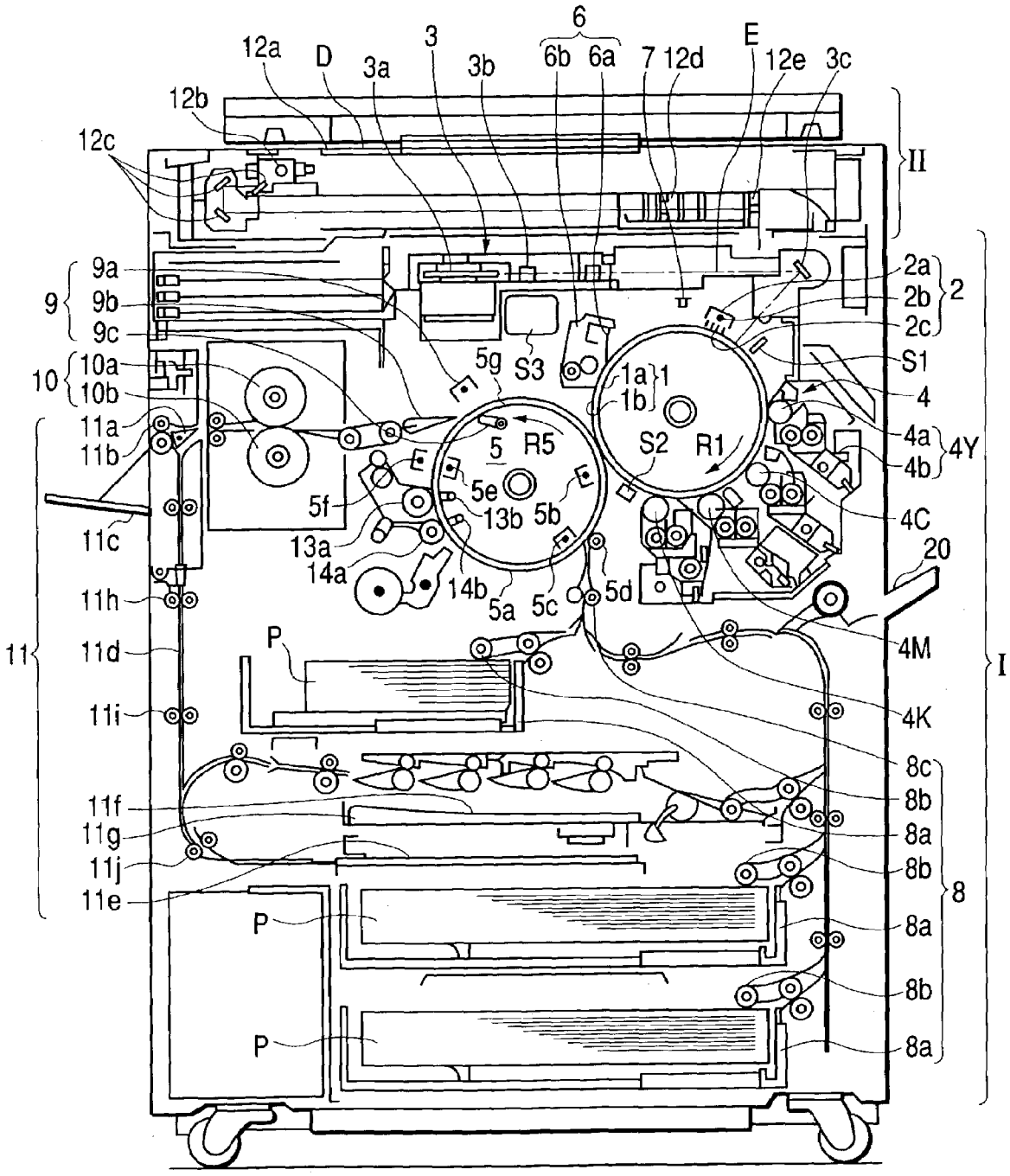
FIG. 1 is a longitudinal sectional view showing a general construction of an image forming apparatus according to the present invention.

Hereinbelow, embodiments of the present invention will be descried with reference to the accompanying drawings. Note that, throughout the figures, the same reference numerals are used to denote the same or similar constructions or functions, and the repeated description thereof is omitted as appropriate.

First, a brief description of the present invention will be given.

In an image forming apparatus according to the present invention, of a developer including toner and carrier which is contained in a developing container of a developing device, the toner consumed by repeating image formation can be replenished. Such a replenishing developer (composed of toner, or of toner and carrier) is filled in a sealed container (developer supplying container) detachably mounted to the image forming apparatus, so that developer is supplied from the sealed container into the image forming apparatus as appropriate by the user. Further, in an image forming apparatus in which the latent image contrast is changed according to an absolute moisture content obtained from environmental information (temperature and relative humidity) detected by an environmental sensor provided in the image forming apparatus, and in which developer density detection is performed by forming a patch latent image for density detection on an image bearing member, developing the patch latent image by the developing device using the above-described developer to form (develop) a patch image, and detecting the density of the patch image by a density sensor, the image forming apparatus of the invention is characterized in that, when setting an initial target value to be compared against a detection output of the density sensor, a patch latent image formed at a latent image contrast that is based on the moisture content detected by the environmental sensor is developed to form a patch image so as to have a predetermined density, the density is detected by the density sensor, and a value obtained by correcting (adding a predetermined amount of change to) the detection output is set as the initial target value (initial density).

The predetermined amount of change described above is determined by the moisture content detected by the environment sensor when setting the initial density. Further, the amount of change determined by the moisture content refers to a density differential between the case where a patch latent image is developed using a developer moisture-conditioned to the moisture content detected by the environmental sensor and the case where it is developed using a developer moisture-conditioned to the moisture content within the sealed container filled with supplying developer, the patch latent image being formed at a latent image contrast that is based on the moisture content detected by the environmental sensor.

The addition of the predetermined amount of change is preferably performed in a stepwise manner.

Embodiment 1

An example of an image forming apparatus according to the present invention is shown in FIG. 1. The image forming apparatus shown in FIG. 1 is an electrophotographic digital image forming apparatus capable of 4-color full-color image formation. FIG. 1 is a longitudinal sectional view showing the construction of the apparatus.

The construction and operation of the entire image forming apparatus will be described with reference to FIG. 1.

The image forming apparatus of the present invention shown in FIG. 1 includes a digital color image printer portion (hereinafter simply referred to as the "printer portion") I provided in a lower part and a digital color image reader portion (hereinafter simply referred to as the "reader portion") II provided in an upper part of the apparatus. For example, an image is formed on a recording material P by the printer portion I based on an image of a document D read by the reader portion II.

Hereinbelow, the construction of the printer portion I and then the construction of the reader portion II will be described.

The printer portion I has a photosensitive drum 1 serving as an image bearing member rotationally driven in the direction of an arrow R1. Arranged around the photosensitive drum 1 along the rotation direction thereof are a primary charger (charging means) 2, an exposure device (exposure means) 3, a developing device (developing means) 4, a transfer device (transfer means) 5, a cleaning device (cleaning means) 6, and a pre-exposure lamp (pre-exposure means) 7 etc.

Provided below the transfer device 5, that is, in the lower half part of the printer portion I is a feed and transport portion (feed and transport means) 8 for a recording material P. In addition, a stripping device (stripping means) 9 is arranged above the transfer device 5, and also a fixing device (fixing means) 10 and a sheet delivery portion (sheet delivery means) 11 are arranged on the downstream side (on the downstream side with respect to the transport direction of the recording material P) of the stripping device. Further, an environmental sensor (not shown) serving as an environment detection means is arranged in the vicinity of the developing device 4 of the printer portion I. In this embodiment, provided as the environmental sensor is a humidity sensor that detects the ambient humidity in the vicinity of the developing device.

The photosensitive drum 1 has a drum-shaped base 1*a* formed of aluminum and an OPC (organic photoconductor) photosensitive layer 1*b* covering the base 1*a*. The photosensitive drum 1 is rotationally driven by a driving means (not shown) in the arrow R1 direction at a predetermined process speed (peripheral speed).

The primary charger 2 is constituted by a corona charger of a scorotron type, for example. The primary charger 2 has a shield 2*a* that is open at the portion opposing the photosensitive drum surface, a discharge wire 2*b* arranged inside of the shield 2*a* in parallel to the generating line of the photosensitive drum surface, and a grid 2*c* for regulating a charged potential which is arranged in the opening portion of the shield 2*a*. The primary charger 2 is applied with a charging bias by a charging bias application power source (not shown), thereby evenly (uniformly) charging the photosensitive drum surface in a predetermined polarity/potential.

The exposure device 3 has a laser output portion (not shown) for emitting laser light E based on an image signal from the reader portion II, a polygon mirror 3*a* that reflects the laser light E, a lens 3*b*, and a mirror 3*c*. The exposure device 3 performs exposure by irradiating the laser light E onto the photosensitive drum surface, to form an electrostatic latent image by removing electric charge from the exposed portion. In this embodiment, an image of the document D is color-separated into four colors of yellow, cyan, magenta, and black. Electrostatic latent images corresponding to the respective colors are successively formed on the photosensitive drum surface.

The developing device 4 includes four developing units, that is, developing units 4Y, 4C, 4M, and 4K arranged in this order from the upstream side along the rotation direction of the photosensitive drum 1. Those four developing units 4Y, 4C, 4M, and 4K each has a developing container (not shown). Those developing containers each contain a two-component developer including toner and carrier of yellow (Y), cyan (C), magenta (M), and black (K), respectively, and having resin as its base material. The respective developing units 4Y, 4C, 4M, and 4K each has a developing sleeve 4*a* and an eccentric cam 4*b* for moving the developing sleeve 4*a* toward or away from the photosensitive drum surface (note that, in FIG. 1, only those of the yellow developing unit 4Y are shown). The developing sleeve 4*a* carries a developer on its surface to feed it to the developing portion opposed to the photosensitive drum 1, thereby depositing toner onto an electrostatic latent image on the photosensitive drum to develop it as a toner image. When developing an electrostatic latent image, a developing unit of a predetermined color to be used for the development is arranged in a developing position proximate to the photosensitive drum surface alternatively by means of the eccentric cam 4*b* so that an electrostatic latent image is developed by depositing toner thereon through the developing sleeve 4*a*, thereby visualizing the electrostatic latent image as a toner image. The remaining three developing units other than the developer unit to be used for the development are arranged in retreat positions located apart from the developing position.

In this embodiment, hoppers are provided for receiving toner to be supplied to the respective developing units 4Y, 4C, 4M, and 4K. From each hopper, an amount of toner (or toner and carrier) corresponding to the density of a patch image described later is supplied to the developing container. The supplying of toner serves to regulate the density of a patch image to a predetermined density.

Note that, a construction is also possible in which developer is directly supplied to each developing container from each developer supplying container such as a developer cartridge receiving developer to be supplied.

Further, as described above, as the developer to be supplied, not only toner but also a mixture of toner and carrier may be supplied.

The transfer device 5 includes: a transfer drum (recording-material carrying member) 5*a* that carries the recording material P on its surface; a transfer charger 5*b* for transferring a toner image on the photosensitive drum onto the recording material P; an attracting charger 5*c* for electrostatically attracting the recording material P onto the transfer drum 5*a* and an attracting roller 5*d* opposing the attracting charger 5*c*; and an inside charger 5*e* and an outside charger 5*f*. The transfer drum 5*a* is axially supported so as to be rotationally driven in the direction of an arrow R5, and in an open area of its peripheral surface, a recording-material carrying sheet 5*g* formed of a dielectric is integrally provided in tension in a cylindrical fashion. A dielectric sheet of a polycarbonate film or the like is used for the recording material carrying sheet 5*g*.

The cleaning device 6 is provided with a cleaning blade 6*a* for scraping off toner (residual toner) remaining on the photosensitive drum surface which has not been transferred onto the recording material P, and a collecting container 6*b* for receiving toner that has been scraped off.

The pre-exposure lamp 7 is arranged on the upstream side of the primary charger 2 so as to be adjacent thereto. The pre-exposure lamp 7 is used for removing unnecessary electric charge present on the photosensitive drum surface that has been cleaned by the cleaning device 6.

The feed and transport portion 8 has plural feed cassettes 8*a* in which recording materials P of different sizes are stacked and received, a feed roller 8*b* for feeding the recording material P contained in each feed cassette 8*a*, multiple transport rollers, and a registration roller 8*c*, etc. By the feed and transport portion 8, recording material P on which an image is to be formed is supplied toward the transfer drum 5*a*. Note that, recording material P to be manually fed is fed from a manual feed tray 20.

The stripping device 9 has a stripping charger 9*a* for stripping from the transfer drum 5*a* recording material P on which a toner image has been transferred, a stripping claw 9*b*, and a stripping push-up roller 9*c*, etc.

The fixing device 10 has a fixing roller 10*a* having a heater provided inside, and a pressurizing roller 10*b* arranged below the fixing roller 10*a* for pressing the recording material P onto the fixing roller 10*a*.

The sheet delivery portion 11 has a transport path switching guide 11*a*, a delivery roller 11*b*, and a sheet delivery tray 11*c*, etc., which are arranged on the downstream side of the fixing device 10. Below the transport path switching guide 11*a*, there are arranged a transport vertical path 11*d* for forming an image on both sides of single recording material P, a reverse path 11*e*, a stacking portion 11*f*, an intermediate tray 11*g*, transport rollers 11*h* and 11*i*, and a reverse roller 11*j*, etc.

A potential sensor S1 for detecting the charged potential of the photosensitive drum surface and a density sensor S2 for detecting the density of a toner image on the photosensitive drum are arranged between the primary charger 2 and the developing device 4 and between the developing device 4 and the transfer drum 5*a*, respectively, around the photosensitive drum 1. A description of the density sensor S2 will be given later.

Next, a description will be given of the reader portion II.

The reader portion II arranged above the printer portion I includes a document glass stand 12*a* on which the document D is placed, an exposure lamp 12*b* for scanning an image surface of the document D by exposure while moving, plural mirrors 12*c* for further reflecting light reflected from the document D, and a lens 12*d* for collecting reflected light, a full-color sensor 12*e* for forming a color-separated image signal based on light from the lens 12*d*, etc. The color-separated image signal is sent out to the above-mentioned printer portion I after being subjected to processing by a video processing unit (not shown) via an amplification circuit (not shown).

A brief description will be given of the operation of the image forming apparatus constructed as described above. As the images, four full-color images of yellow, cyan, magenta, and black are formed in the stated order.

An image of the document D placed on the document glass stand 12*a* of the reader portion II is subjected to irradiation by the exposure lamp 12*b* to be color-separated. Then, an image of yellow is first read out by the full color sensor 12*e*, which is subsequently sent to the printer portion I as an image signal after being processed in a prescribed manner.

In the printer portion I, the photosensitive drum 1 is rotationally driven in the arrow R1 direction and its surface is uniformly charged by the primary charger 2. Based on the image signal sent from the above-described reader portion II, laser light E is irradiated from a laser output portion of the exposure device 3. The surface of the photosensitive drum that has been electrically charged is exposed to the laser light E via the polygon mirror 3*a* and the like. Electric charge is removed from a portion of the photosensitive drum surface which is subjected to the exposure so that an electrostatic latent image corresponding to a yellow component color is formed.

In the developing device 4, the developing unit 4Y for yellow is arranged in a predetermined developing position whereas the other developing units 4C, 4M, and 4K are retreated from the developing position. By the developing unit 4Y, yellow toner is deposited on the electrostatic latent image formed on the photosensitive drum, thereby developing a yellow toner image. The yellow toner image on the photosensitive drum is transferred onto the recording material P carried on the transfer drum 5*a*.

As the recording material P, a recording material of a size suitable for a document image is supplied at predetermined timings toward the transfer drum 5*a* from a predetermined feed cassette 8*a* by way of the feed roller 8*b*, the transport rollers, and the registration roller 8*c*, etc. The recording material P supplied in this way is attracted and wound onto the recording-material carrying sheet 5*f* on the transfer drum surface, and is rotated as the transfer drum 5*a* rotates in the arrow R5 direction, so that the transferring of the yellow toner image formed on the photosensitive drum is performed by the transfer charger 5*b*.

As for the photosensitive from 1 on which the toner image has been transferred, any residual toner on its surface is removed by the cleaning device 6 and unnecessary electric charge is further removed therefrom by means of the pre-exposure lamp 7, leaving it ready to begin image formation for the next color which commences with the above-described primary charging process.

The series of image forming process for the yellow color described above, which includes the reading of the document D, primary charging, exposure, developing, transfer, and cleaning, is performed in the same manner also with respect to the colors other than yellow, that is, with respect to cyan, magenta, and black, whereby a color image is formed on the recording material P on the transfer drum by superimposing toner images of four colors, that is, yellow, magenta, cyan, and black, on top of each other.

The recording material P on which toner images of four colors have been transferred is stripped from the transfer drum 5*a* by means of the stripping charger 9*a*, the stripping claw 9*b*, and the like. The stripped recording material P is transported to the fixing device 10 while bearing on its surface an unfixed four-color toner image. The recording material P is heated and pressurized by the fixing roller 10*a* and the pressurizing roller 10*b* of the fixing device 10, thereby fusing the toner image to the surface thereof. The recording material P having the toner image thus fixed thereon is delivered onto the sheet delivery tray 11*c* by the delivery roller 11*b*.

In a case where images are to be formed on two sides of the recording material P, the transport path switching guide 11*a* is driven immediately after the recording material P exits the fixing device 10, so that the recording material P is once guided to the reverse path 11*e* via the transport vertical path 11*d*. Then, when subjected to reverse rotation effected by the reverse roller 11*j*, what was the trailing edge of the recording material P as it was fed becomes the leading edge, so that the material leaves the reverse roller 11*j* in a direction opposite to the direction in which it was fed, to be received in the intermediate tray 11*g*. Subsequently, after an image is formed on the other surface of the recording material P again by the above-described image forming process, the recording material P is delivered onto the sheet delivery tray 11*c*.

In the transfer drum 5*a* from which the recording material P has been stripped, in order to prevent scattering and deposition of fine particles onto the recording-material carrying sheet 5*g*, deposition of oil on the recording material P, and the like, cleaning of the drum is effected by a fur brush 13*a* and a back-up brush 13*b* which are opposed to each other through the recording material carrying sheet 5*g*, as well as by an oil removing roller 14*a* and a buck-up brush 14*b* similarly opposed to each other. Such cleaning is performed before or after image formation, and also as the necessity arises due to occurrence of a jam (paper jam).

Figure 6:
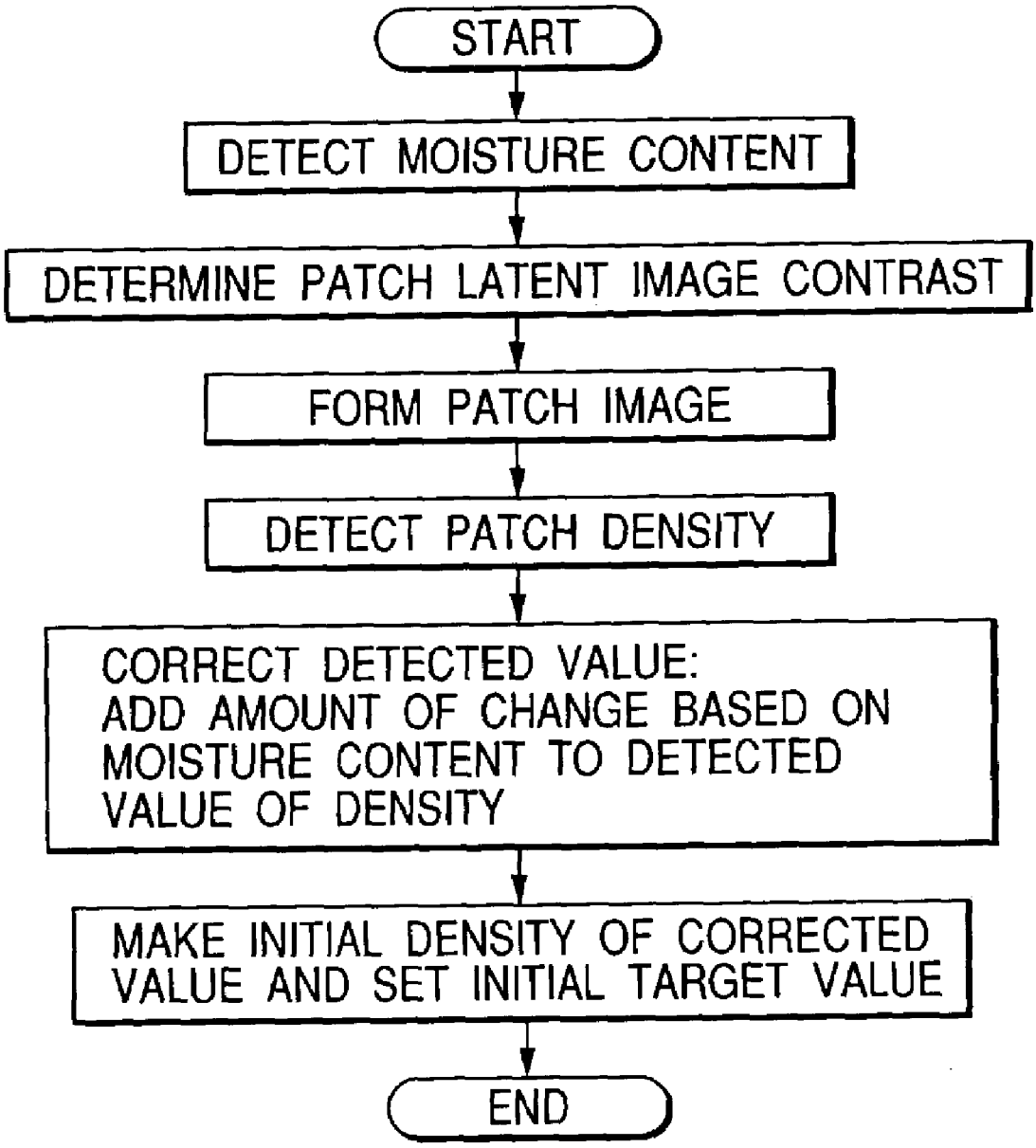
FIG. 6 shows a flowchart for setting an initial target value.

Next, a description will be given of a method for determining a developer supplying amount, which constitutes a feature of the present invention (see FIG. 6).

Figure 2:
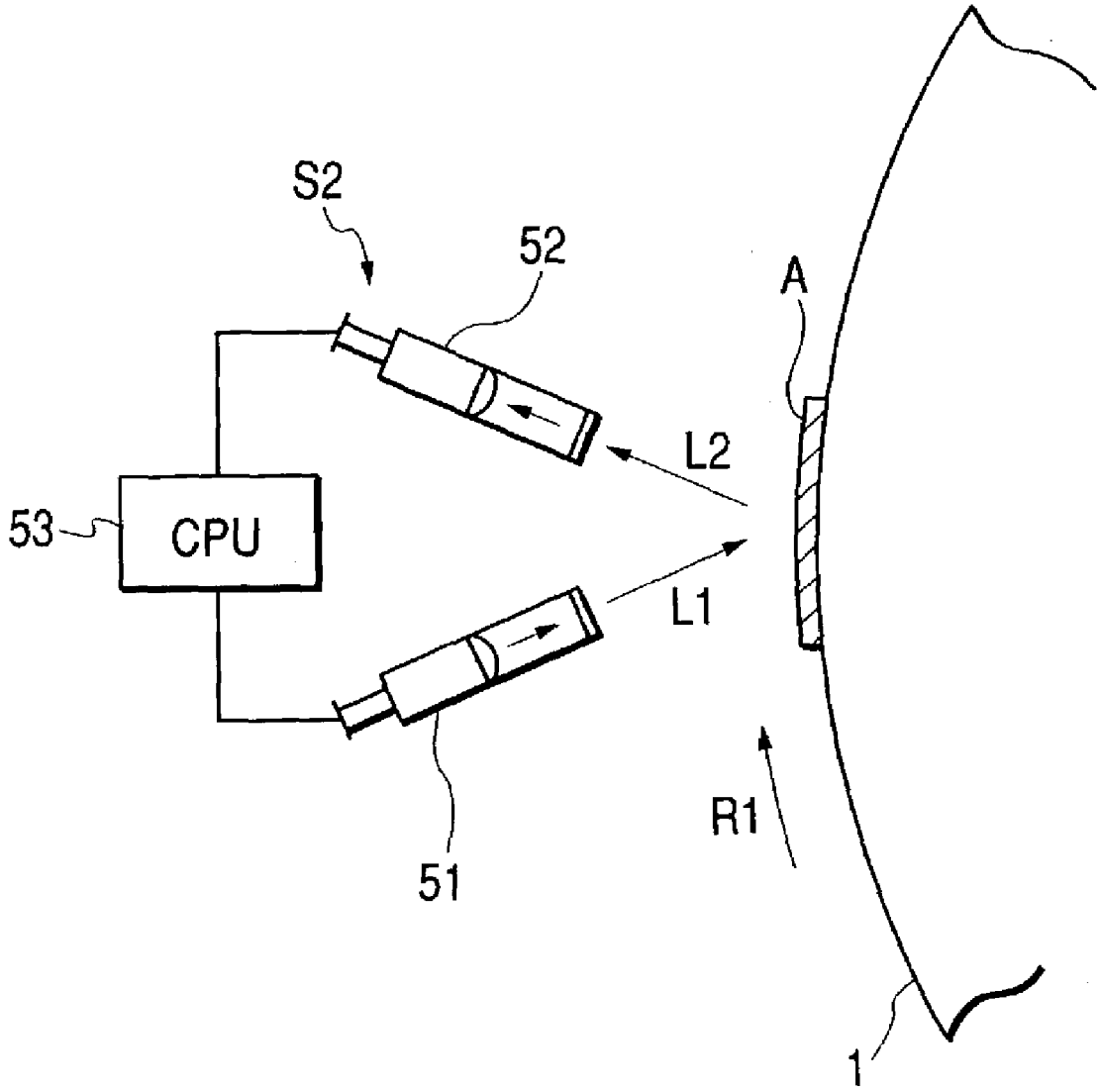
FIG. 2 is a view for explaining a density sensor (optical sensor) used for density detection of a patch image in the present invention.

The above-described density sensor S2 is constructed of, for example, a reflection optical sensor having a light emitting portion 51 and a light receiving portion 52 as shown in FIG. 2. The light emitting portion 51 and the light receiving portion 52 are connected to a CPU (control unit) 53. Irradiation light L1 generated from the light emitting portion 51 is reflected by a patch image A formed on the photosensitive drum. The thus reflected light L2 is received by the light receiving portion 52. The amount of the reflected light L2 received is converted into an output voltage by the CPU 53.

The above-described patch image A is obtained by developing a patch latent image, which is formed by exposing an electrically charged photosensitive drum surface to the laser light E from the exposure device 3 (see FIG. 1), as a toner image by depositing toner thereon by the developing device 4. The density of the patch image A at this time can be changed relatively easily by changing the latent image contrast (a difference in potential between a bright section (image section) and a dark section (non-image section)) by the above-described CPU 53 on the basis of the intensity of the laser light E, for example.

Therefore, according to the present invention, by varying the latent image contrast by changing the intensity of the laser light E during the density control, plural patch images having different densities are formed and the densities of the respective patch images are detected.

In this case, even if the latent image contrast remains constant, the density of a patch image varies in accordance with the moisture content of developer. Thus, in order to detect the ambient moisture content of the image forming apparatus by the environmental sensor S3 (see FIG. 1) and cancel the amount of change in density attributable to the moisture content, the CPU 53 controls the latent image contrast that is determined on the basis of the laser light E.

Now, referring to FIG. 3, a description will be given of a method for setting an initial density and a method for determining a supplying amount of developer in accordance with this embodiment.

An image forming apparatus according to the present invention is characterized by including: an image forming unit (the primary charger 2, the exposure device 3, and the developing device 4) for forming the image for density detection (patch image) A on the image bearing member (photosensitive drum) 1, based on image forming conditions determined according to an ambient environment (humidity) and using a two-component developer contained in the respective developing containers of the developing units 4Y, 4C, 4M, and 4K; the density sensor S2 for detecting the density of the image for density detection; a correcting unit for correcting a detected output of the density sensor S2; an initial setting unit for setting a correction value, which is obtained by the correction unit, as an initial target value to be compared against a detected output of the density sensor S2; and a determination unit for determining an amount of developer to be supplied from the developer supplying container into the developing container in accordance with a detected output of the density sensor S2 and the above-mentioned initial target value.

The correcting unit, the initial setting unit, and the determination unit described above are all provided within the CPU 53.

Figure 3:
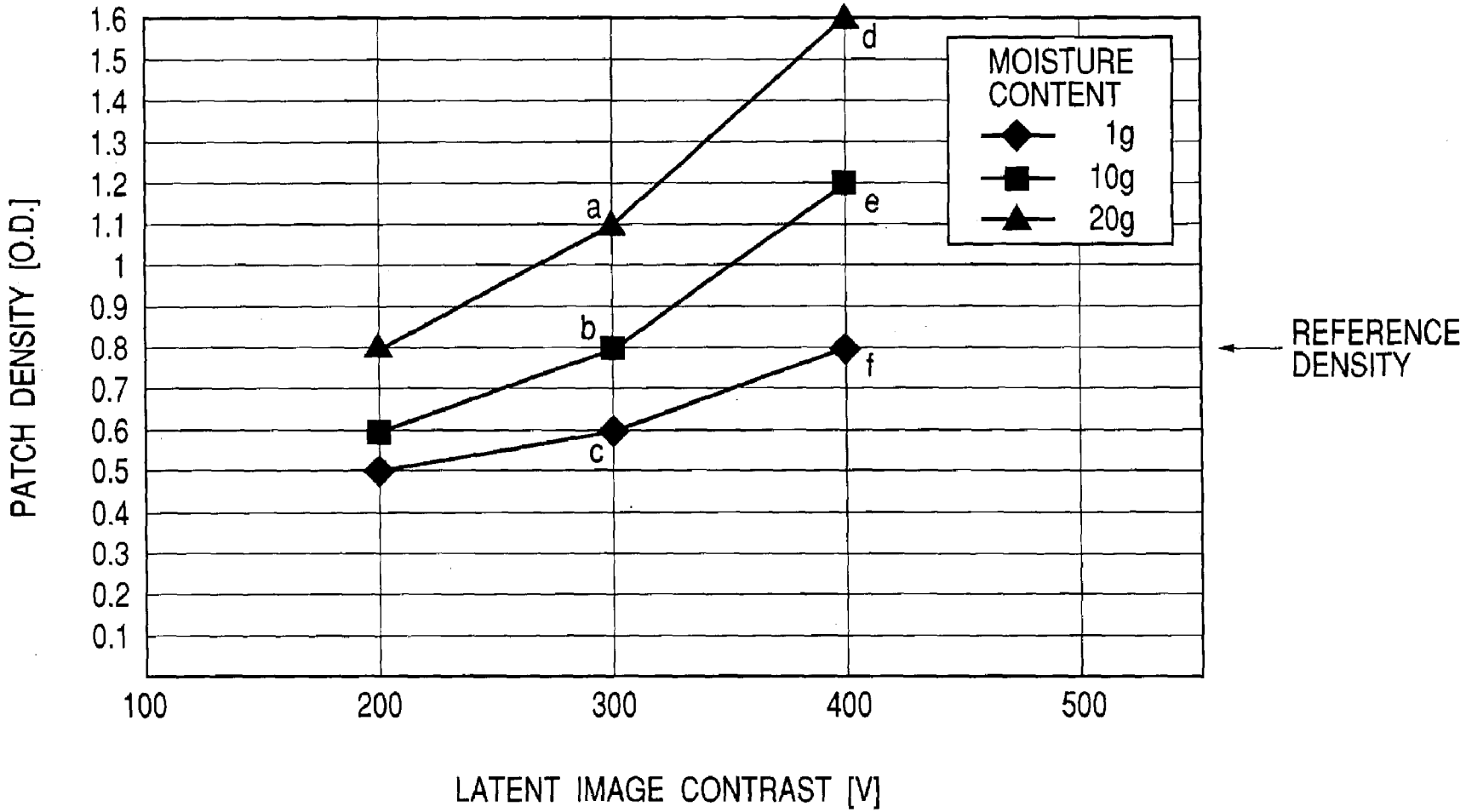
FIG. 3 is a graph showing a relationship between a latent image contrast and a patch density, which is used for explaining a method for setting an initial density according to the present invention.

FIG. 3 described above shows a relationship between the latent image contrast and the patch density (the density of a patch image, hereinafter referring to the same), when using developers sufficiently moisture-conditioned to moisture contents per 1 $m^3$ of 1 g, 10 g, and 20 g. The horizontal axis in the same figure represents the latent image contrast (V), and the vertical axis represents the patch density (optical density: O.D.).

The developing bias is set to an appropriate value at this time. Changing of the contrast is effected by changing the grid potential (dark section potential Vd). Vback (the difference between the dark section potential and the direct-current component (DC) of the developing bias) is fixed (120V), and the developing bias is determined as appropriate for each contrast. Since the triboelectricity (triboelectrification charge amount) of developer (toner) decreases as the moisture content becomes higher, even with the same latent image contrast, the patch density is higher for developer with a higher moisture content.

Note that, as for the patch density in FIG. 3, considering variations in the density sensor S2 according to the model of the image forming apparatus, and temperature characteristics or the like of the LED of the light emitting portion 51, etc., a patch image formed on the photosensitive drum is once transferred onto paper as the recording material P, and the density of the transferred patch image is obtained by measurement using one common reflection density-measurement device (X-Rite 404).

The patch densities in the cases of the moisture contents of 1 g, 10 g, and 20 g are 0.6 (point c), 0.8 (point b), and 1.1 (point a), respectively, when the latent image contrast is 300 V, whereas when the latent image contrast is 400 V, the patch densities are 0.8 (point f), 1.2 (point e), and 1.6 (point d), respectively. The reference density for the patch density is set as 0.8. With the moisture contents of 1 g, 10 g, and 20 g, the latent image contrasts with which the patch density becomes 0.8 are 400 V, 300 V, and 200 V, respectively.

Figure 4:
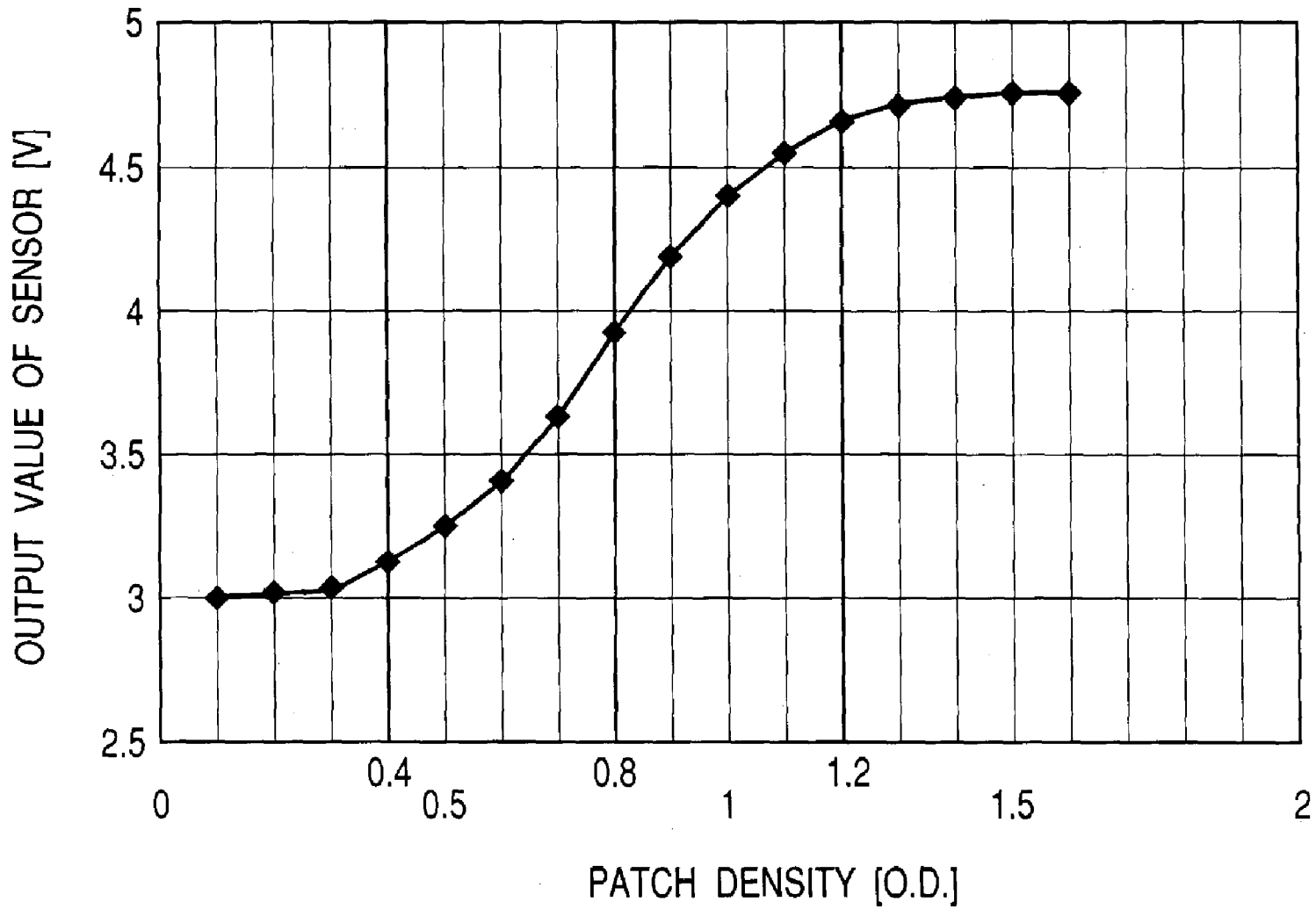
FIG. 4 is a graph showing a relationship between a patch density and an output value (output voltage) of the density sensor.

FIG. 4 shows a relationship between the patch density and the sensor output value (output voltage) of the density sensor. The patch density (O.D.) is taken on the horizontal axis and the output value of the sensor (V) is taken on the vertical axis. As can be seen from FIG. 4, the sensitivity (sensitivity with respect to the patch density) of the density sensor S2 is most favorable when the patch density is 0.8, that is, when the gradient of the density-output curve becomes the maximum. Note that, previous studies have found that the patch density can be controlled in a satisfactory manner if it is in the range of 0.4 to 1.2.

Accordingly, in this embodiment, a patch density of not lower than 0.4 but not larger than 1.2 is set as the possible setting range for the initial density. As for the relationship between the patch density and the developer density, it is known that a change in the patch density by 0.2 results in 1% change in the developer density. It is also known that fogging and toner scattering become severe if the developer density increases by 3% or more from the initial density, and that if it increases by 4% or more therefrom, developer overflows from the developing unit. In view of this, the change in the developer density must be limited within 3%, and therefore the change in the patch density must be limited within 0.6.

According to this embodiment, in order to use a high sensitivity region of the density sensor, the setting of the latent image contrast is adapted to respective environments so that the patch density becomes 0.8 at the time of initial setting. The setting value for the latent image contrast is determined on the basis of the results from previous studies, and it roughly satisfies the above-mentioned possible initial density setting range of 0.4 to 1.2. In a case where it deviates from the above-mentioned possible setting range at the time of initial setting, the initial setting is performed again by changing the intensity of the laser light E. When performing the setting again, if the density exceeds 1.2, the laser output level is lowered by 16, whereas if the density is below 0.4, the laser output level is raised by 16 to form a patch. The laser output level is variable between 0 and 255 (8 bit), with the level of 255 achieving the maximum density.

With the arrangement of this embodiment, under the conditions that the moisture content of the image forming apparatus detected by the environmental sensor is 1 g and the moisture content within the developing container is 10 g, for instance, an initial density setting is performed by setting the latent image contrast to 400 V. The latent image contrast of 400 V is a value with which the patch density becomes 0.8 when the moisture content of the image forming apparatus detected by the environmental sensor is 1 g. The latent image contrast is set such that the patch densities obtained by development using developers moisture-conditioned according to the respective moisture contents become equal to the reference density of 0.8.

As can be seen from FIG. 3, the initial density of the patch image as set under the conditions described above is 1.2 as represented by the point e. This indicates a density deviation of 0.4 from the value of 0.8 at the point f representing the case where developer is moisture-conditioned to the moisture content of 1 g. If the initial setting is performed under the above conditions as they are and then developer is moisture-conditioned, because the patch density decreases, toner is supplied to the developing unit so as to control the patch density to 1.2. At this time, the developer density increases by 2%. That is, the target developer density becomes higher. As described above, fogging or toner scattering becomes frequent if the developer density increases by 3% or more from the initial density. Thus, if the target value itself becomes higher by 2%, the margin provided against the possible fogging and toner scattering becomes 1%. As a result, there are cases where the developer density within each developing container (T/C ratio (the weight ratio of toner to the weights of toner and carrier)) increases by 3% or more from its initial value even during normal usage due to various variation factors, resulting in an occurrence of fogging or toner scattering.

Thus, in accordance with this embodiment, a predetermined amount of change is added to the density detected at the time of the initial setting and the resulting value is set as the initial density (initial target value), so as to cancel a difference in density between the case where a patch latent image is developed using a developer moisture-conditioned to the moisture content detected by the environmental sensor and the case where the patch latent image is developed using a developer moisture-conditioned to the moisture content within a sealed container filled with supplying developer, the patch latent image being formed at a latent image contrast that is based on the moisture content detected by the environmental sensor.

In this embodiment, since the conditions are set such that the moisture content of the image forming apparatus detected by the environmental sensor is 1 g and the moisture content within the sealed container is 10 g, a difference between the initial patch density and the patch density after the moisture conditioning is set as −0.4. This value is added to the patch density of 1.2 at the time of the initial setting, so that the initial density is set as 0.8. In this case, fogging or toner scattering described above does not occur, and it is possible to accurately control the developer density within each developing container.

Figure 5:
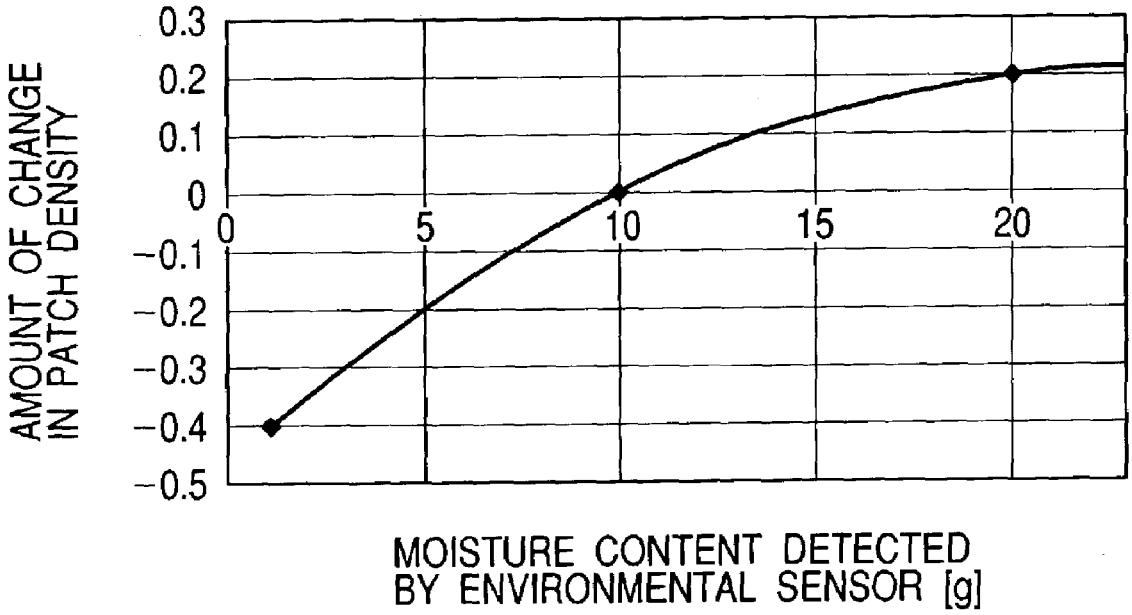
FIG. 5 is a graph showing an amount of change in patch density with respect to a moisture content detected by an environmental sensor (humidity sensor)

The amount of change in patch density with respect to the moisture content detected by the environmental sensor is determined as shown in FIG. 5 based on the data of FIG. 3. In this embodiment, an amount of change in patch density with respect to a moisture content detected by the environmental sensor at the time of initial setting is selected from the table of FIG. 5 and the amount is added to a detected patch density and the resulting value is automatically set as the initial density.

Thereafter, the density control subsequent thereto is performed on the basis of the initial density (initial target value) thus obtained. That is, a comparison is made between a detected output of the density sensor and the initial density, and an amount of toner to be supplied from the hopper into the developing container is determined based on the results of the comparison. Then, the amount of toner thus determined is supplied so that the density of developer within the developing container becomes a predetermined value.

Embodiment 2

An image forming apparatus according to this embodiment is characterized in that, in performing the density control of developer, the system (patch detection ATR) employed in Embodiment 1 in which control is effected by detecting the patch density with the density sensor is combined with a system (developer reflection ATR) in which control is effected by detecting a developer density within the developing container based on an amount of reflected light using a density sensor (optical sensor) installed within the developing container. It is preferred that the developer reflection ATR sensor be arranged such that it can detect a developer density on the developing sleeve at a time after developer is drawn up onto the developing sleeve from the developing container but before the developer is carried to the developing region.

According to the developer density control of this embodiment, the supplying of toner is performed by the developer reflection ATR. In this embodiment as well, an initial setting similar to that of Embodiment 1 described above is performed to set an initial patch density as a target value. In addition, an output value of the developer reflection ATR is also set as a target value of the developer reflection ATR at the time of the initial setting. By the developer reflection ATR, the supplying of toner is performed by looking at a difference between the target value and the current output value. Further, from an output signal representative of a difference in density (a difference between the target value and the detected value) of a patch image, an amount of toner to be added or subtracted for returning the patch image density to the initial density is calculated by the control device CPU. The toner supplying amount thus obtained is set as a correction amount for the developer reflection ATR target value and converted into a corresponding signal level, so that the developer reflection ATR corrects the set target density and performs a toner supply control by the developer reflection ATR system using the toner supplying amount that is based on the corrected target value. Further, lower and upper limit values are set for the correction amount for the purpose of image stability. In this embodiment, the control by the developer reflection ATR is performed every time each developing unit becomes ready for development (once every time one sheet is outputted), and the control by the patch detection ATR is performed once every time 25 sheets are outputted.

In the above-described developer density control as well, as in Embodiment 1 described above, the initial density of a patch image is determined by adding to an initial detected density an amount of change corresponding to a moisture content, thereby making it possible to suppress variations in the developer density occurring due to moisture-conditioning of developer.

Embodiment 3

Figure 7:
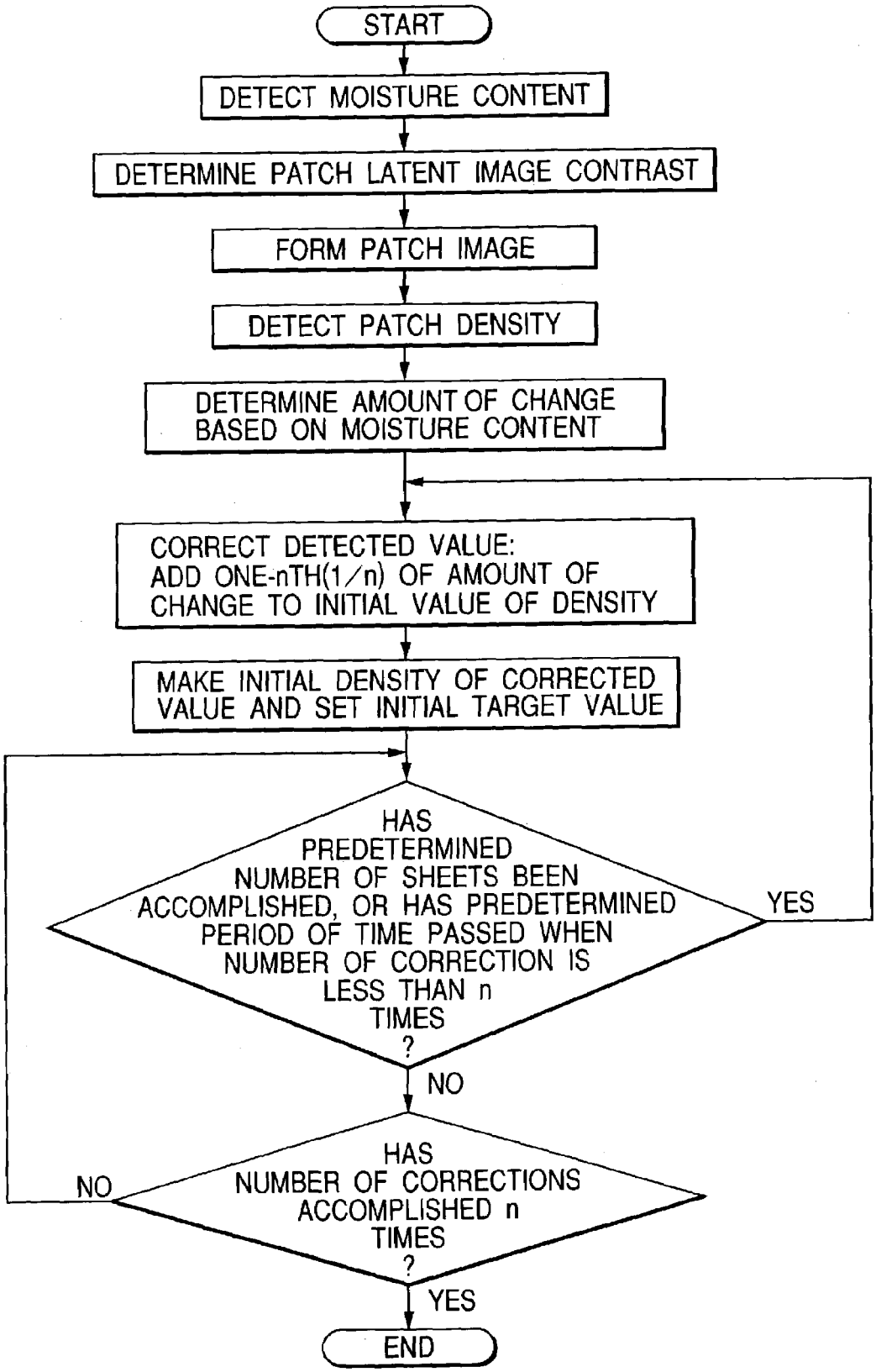
FIG. 7 shows a modified example of the flowchart for setting the initial target value.

The feature of this embodiment resides in that an amount of change for a target value at the time of the initial setting is added in a stepwise manner to an initial density (see FIG. 7).

This embodiment will be described with reference to FIG. 3. The setting conditions for an initial density are the same as those of Embodiment 1 described above. Thus, the initial density of the patch image is 1.2 as represented by the point e. Thereafter, if the developer is moisture-conditioned to the water content of 1 g, the patch density drops to 0.8 as represented by the point f. At this time, the correction of the patch density is performed by addition of an amount of change.

However, if the amount of change is added at once at the time of the initial setting, the developer density is conversely lowered until the time when the developer is moisture-conditioned, causing a reduction in the output image density. Hence, by adding the amount of change in a stepwise manner in accordance with the degree of moisture conditioning of the developer, the developer density can be controlled with higher accuracy. The timing for the stepwise addition of the amount of change may be determined on the basis of time elapsed since the initial setting, the number of output sheets (the number of sheets on which images have been formed), or the like. For instance, consider a case where the method of adding an amount of change in a stepwise manner according to this embodiment is applied to Embodiment 2. In this case, if one-tenth of the amount of change ("n"=10 in FIG. 7) is added to the initial density every time the patch ATR is performed, and the change of the initial density is completed upon performing the addition for 10 times (upon performing the patch ATR for 10 times), it means that the target value is changed in a stepwise manner during a period of the time until 250 sheets are outputted. Since the moisture-conditioning of the developer sufficiently proceeds during the period of time, it is possible to avoid a reduction in density that will occur if the initial density is changed at once.

As has been described above, according to the present invention, the initial setting of the target value for the density sensor is performed at the time of the initial installation of the image forming apparatus or the like by taking into account the state of moisture-conditioning of the developer, whereby the developer density within the developing container can be detected with accuracy and therefore the supplying amount of the developer can be determined with accuracy to achieve fine density control.

What is claimed is:

1. An image forming apparatus comprising:

image forming means for forming a toner image on an image bearing member by using a developer, said image forming means having a developing unit containing the developer;

a density sensor configured to detect a density of a detection toner image formed by said image forming means; and control means for controlling an amount of the developer to be supplied from a sealed developer supply container to said developing unit in accordance with data obtained from an output of said density sensor and a target value, wherein said control means comprises:

means for detecting information relating to an ambient environment where said image forming apparatus is placed when developer is first supplied from the sealed supply container to said developing unit;

means for forming the detection toner image by said image forming means on the basis of an image forming condition that is changed in accordance with the information relating to the ambient environment detected when developer is first supplied from the sealed supply container to said developing unit;

means for obtaining data by said density sensor detecting the detection toner image formed on the basis of the image forming condition that is changed in accordance with the information relating to the ambient environment detected when developer is first supplied from the sealed supply container to said developing unit; and means for substituting a value obtained by correcting the data obtained from the output of said density sensor by using an amount of change according to the detected information relating to the ambient environment for the target value to produce an initial density setting.

2. An image forming apparatus according to claim 1, wherein said image forming means forms the detection toner image such that the density of the detection toner image takes place within a high sensitivity region of said density sensor.

3. An image forming apparatus according to claim 1, wherein said control means corrects the output of said density sensor in a stepwise manner, and successively sets as the target value a value that is corrected in a stepwise manner.

4. An image forming apparatus according to claim 3, wherein said control means corrects the output of said density sensor in a stepwise manner based on one of the following events: every time a predetermined period of time elapses; and every time image formation is performed for a predetermined number of times.

* * * * *

UNITED STATES PATENT AND TRADEMARK OFFICE

CERTIFICATE OF CORRECTION

PATENT NO. : 7,242,876 B2
APPLICATION NO. : 10/411104
DATED : July 10, 2007
INVENTOR(S) : Nobuhiko Zaima It is certified that error appears in the above-identified patent and that said Letters Patent is hereby corrected as shown below:

ON THE TITLE PAGE:

At Item (56), FOREIGN PATENT DOCUMENTS, "043109783 A," should read --4-310978 A,-- and "2001194837 A," should read --2001-194387 A--.

COLUMN 3:

Line 20, "descried" should read --described--.

COLUMN 5:

Line 19, "Those four" should read --Each of those four--;
Line 20, "each has a" should read --has a--;
Line 21, "Those developing" should read --Each of those developing-- and "each contain" should read --contains--;
Line 24, "The respective" should read --Each of the respective--; and
Line 25, "each has a" should read --has a--.

Signed and Sealed this

Twenty-ninth Day of April, 2008

JON W. DUDAS
*Director of the United States Patent and Trademark Office*